US008159452B2

(12) United States Patent
Toyooka

(10) Patent No.: US 8,159,452 B2
(45) Date of Patent: Apr. 17, 2012

(54) IMAGE DISPLAY DEVICE AND ELECTRONIC APPARATUS

(75) Inventor: Takashi Toyooka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 640 days.

(21) Appl. No.: 12/355,126

(22) Filed: Jan. 16, 2009

(65) Prior Publication Data

US 2009/0189845 A1 Jul. 30, 2009

(30) Foreign Application Priority Data

Jan. 28, 2008 (JP) ..... 2008-016608

(51) Int. Cl.
*G09G 3/36* (2006.01)

(52) U.S. Cl. ..... 345/102; 345/77; 345/99; 345/691

(58) Field of Classification Search ..... None
See application file for complete search history.

(56) References Cited

U.S. PATENT DOCUMENTS 7,952,556 B2 * 5/2011 Honbo ..... 345/102

FOREIGN PATENT DOCUMENTS

JP A-2004-354717 12/2004

* cited by examiner

*Primary Examiner* — Muhammad N Edun
(74) *Attorney, Agent, or Firm* — Oliff & Berridge, PLC

(57) ABSTRACT

An image display device includes at least one light source that emits light; at least one display area that changes, for each pixel, a transmittance or a reflectance of the light emitted from the light source; a panel driving circuit that drives the display area on the basis of an image signal indicating the transmittance or the reflectance for each pixel; and a light source control unit that controls a proportion of a light emission time of the light source in a period that varies within a predetermined range.

6 Claims, 5 Drawing Sheets

IMAGE DISPLAY DEVICE AND ELECTRONIC APPARATUS

BACKGROUND

1. Technical Field

The present invention relates to a technique for reducing display unevenness in the case of controlling luminance by performing pulse width modulation (PWM) of a light source.

2. Related Art

The luminance of a light source, such as a laser diode (LD) or a light-emitting diode (LED), can be easily adjusted by performing PWM control. This is because PWM is excellent in terms of being established using a digital circuit and ensuring the stability of the light intensity and the circuit. Under such circumstances, a technique in which such a light source is applied to, for example, a projector, has been suggested, for example, in JP-A-2004-354717. In this technique, color changes are reduced, and a display dynamic range is apparently increased.

However, there has been a problem in that PWM control of a light source causes a phenomenon (scroll noise) where band-shaped bright and dark portions extending in a horizontal direction move slowly upward or downward on the screen and that the quality of display is thus severely degraded.

SUMMARY

An advantage of some aspects of the invention is that it provides an image display device and an electronic apparatus that are capable of reducing the occurrence of scroll noise in the case of performing PWM control of a light source.

According to an aspect of the invention, an image display device includes at least one light source that emits light; at least one display area that changes, for each pixel, a transmittance or a reflectance of the light emitted from the light source; a panel driving circuit that drives the display area on the basis of an image signal indicating the transmittance or the reflectance for each pixel; and a light source control unit that controls a proportion of a light emission time of the light source in a period that varies within a predetermined range. In a case where the driving period of a light source is near an integer multiple of the driving period of a display area, since band-shaped bright and dark portions extending in a horizontal direction slowly move upward or downward, such a movement is conspicuous. However, in the invention, since the driving period of a light source varies within a predetermined range, such a movement can be made less conspicuous.

The image display device may further include an analyzing circuit that analyzes a brightness of an image to be displayed in the display area. The light source control unit may change, in accordance with the brightness analyzed by the analyzing circuit, the proportion of the light emission time of the light source in a period of the image signal. With this arrangement, in addition to the feature that the transmittance or the reflectance can be changed by the display area, the apparent dynamic range of a display image can be increased.

In addition, the image display device may further include a stretching circuit that stretches the transmittance or the reflectance of the light defined by the image signal so as to increase the transmittance or the reflectance. Thus, the dynamic range can further be increased.

The light source may include at least three light sources corresponding to individual colors and the display area may include at least three display areas corresponding to individual colors. The image display device may further include an optical system that combines light emitted from the individual display areas and projects the combined light. The light source control unit may be capable of controlling, for each of the display areas, the proportion of the light emission time of the light source in the period of the image signal. With this arrangement, white balance can be adjusted.

In addition, an electronic apparatus having the image display device, as well as the image display device, can fall within the concept of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described with reference to the drawings.

Figure 1:
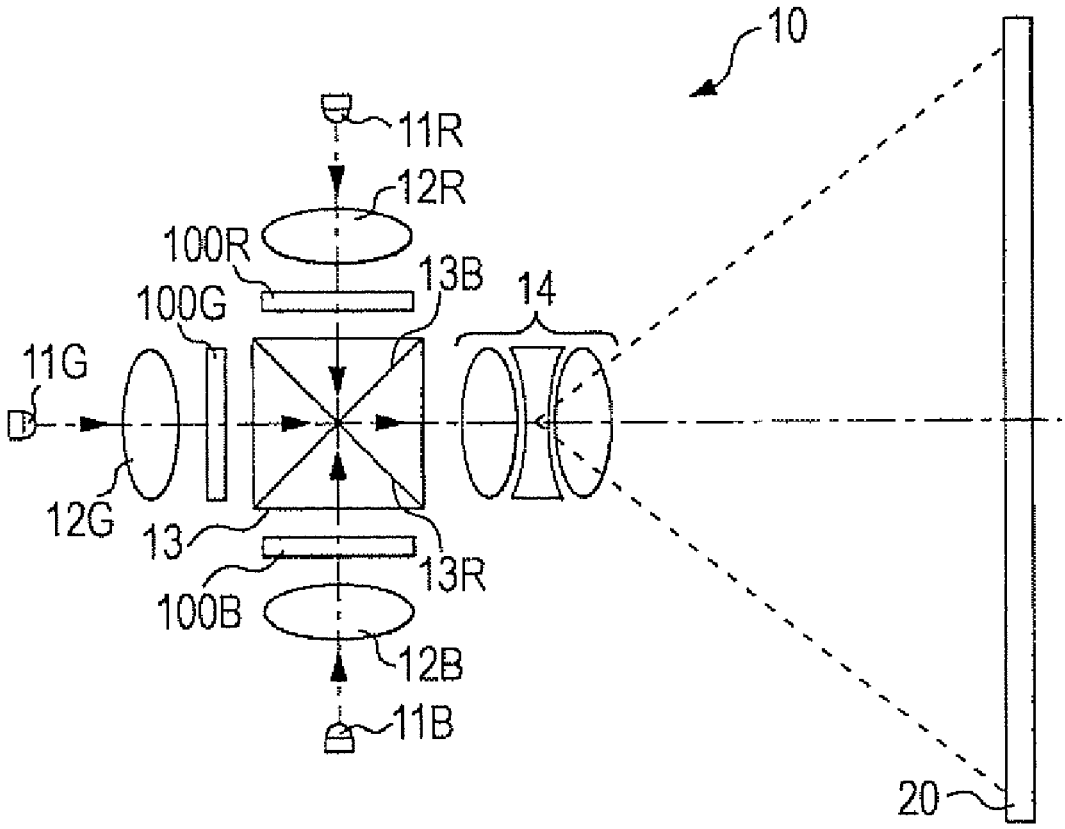
FIG. 1 is a plan view showing an optical configuration of a projector according to an embodiment of the invention.

FIG. 1 is a plan view showing an optical configuration of a projector 10 to which an image display device according to an embodiment of the invention is applied.

Referring to FIG. 1, an LED 11R is an example of a solid-state light source. The LED 11R emits red (R) light and is located in the direction of twelve o'clock when viewed from the center of a dichroic prism 13. A collimator lens 12R collimates red light emitted from the LED 11R and causes the collimated red light to be incident on a display panel 100R. In this embodiment, the display panel 100R is a transmissive liquid crystal panel. The display panel 100R includes a plurality of pixels and changes the transmittance of an individual pixel. Thus, light emitted from the display panel 100R represents an image of red (R) components.

Similarly, LEDs 11G and 11B emit green (G) light and blue (B) light, respectively. Referring to FIG. 1, the LEDs 11G and 11B are located in the directions of nine o'clock and six o'clock, respectively, when viewed from the center of the dichroic prism 13. Collimator lenses 12G and 12B collimate green and blue light emitted from the LEDs 11G and 11B and cause the collimated green and blue light to be incident on display panels 100G and 110B, respectively. The display panels 100G and 100B are transmissive liquid crystal panels corresponding to green and blue light, respectively.

The dichroic prism 13 has dichroic planes 13R and 13B that intersect at right angles. The dichroic plane 13R reflects red light incident from the direction of twelve o'clock to emit the reflected light in the direction of three o'clock and transmits light of the other colors. The dichroic plane 13B reflects blue light incident from the direction of six o'clock to emit the reflected light in the direction of three o'clock and transmits light of the other colors. Meanwhile, green light incident from the direction of nine o'clock is transmitted through the dichroic planes 13R and 13B and directly emitted in the direction of three o'clock.

Thus, images of red, green, and blue light components are combined at the dichroic prism 13 and emitted in the direction of three o'clock.

Projector lenses 14 form an optical system for magnifying a color image obtained through the dichroic prism 13 and projecting the color image onto a screen 20.

An electrical configuration of the projector 10 will be described with reference to FIG. 2.

A panel control circuit 52 generates a control signal Ctr on the basis of a synchronization signal Sync supplied from a host apparatus (not illustrated), and supplies the generated control signal Ctr to each of the display panels 100R, 100G, and 100B.

Although not illustrated in detail, each of the display panels 100R, 100G, and 100B includes a display area and a panel driving circuit. Taking the display panel 100R as an example, the display panel 100R includes a display area 110R and a panel driving circuit 120R. The display area 110R includes pixels that are arranged in association with intersections of a plurality of scanning lines arranged in rows and a plurality of data lines arranged in columns. The panel driving circuit 120R performs scanning of the pixels in a dot sequential method. The panel driving circuit 120R also converts display data indicating the grayscale value of each pixel into a data signal having a voltage corresponding to the grayscale value, and supplies the data signal through a corresponding data line to pixels to be scanned.

The control signal Ctr includes a start pulse Dy for defining the start of vertical scanning for each display panel, a clock signal Cly for sequentially shifting start pulses Dy, a start pulse Dx for defining the start of horizontal scanning for each display panel, a clock signal Clx for sequentially shifting start pulses Dx, and the like. Since the control signal Ctr is commonly supplied to the display panels 100R, 100G, and 100G, scanning operations for pixels on the display panels 100R, 100G and 100B are the same.

More specifically, on each of the display panels 100R, 100G, and 100B, after the start pulse Dy is supplied, scanning lines are sequentially selected from the top in accordance with the number of times the logic level of the clock signal Cly has changed. In addition, after the start pulse Dx is supplied, data lines to be selected are sequentially defined from the left in accordance with the number of times the logic level of the clock signal Clx has changed.

An analyzing circuit 54 calculates the average of grayscale values of images for one frame on the basis of display data Vd that is supplied from the host apparatus in synchronization with the synchronization signal Sync and defining the grayscale value of each of red, green, and blue components. Here, the average of grayscale values of images to be displayed is output as data Brt.

Among the display data Vd, display data on red components is supplied as display data Dr to the display panel 100R. Similarly, among the display data Vd, display data on green components and display data on blue components are supplied as display data Dg and display data Db to the display panels 100G and 100B, respectively. Note that in FIG. 2, only the display panel 100R is shown and the display panels 100G and 100B are not illustrated.

A light source control unit 60 includes a lookup table LUT 62, a PWN signal generation circuit 64, and a light source driving circuit 66.

The LUT 62 converts the average of grayscale values, which is represented by the data Brt, into the duty ratio of a PWM signal, and outputs data Dud representing the duty ratio.

The PWM signal generation circuit 64 generates a PWM signal for driving each of the LEDs 11R, 11G, and 11B on the basis of the ratio represented by the data Dud and the start pulse Dy. The PWM signal generation circuit 64 changes the frequency of the PWM signal within a predetermined range.

In this embodiment, the PWM signal generation circuit 64 changes the frequency of the PWM signal at a point in time after the start pulse Dy is supplied and when a predetermined phase is first reached (for example, a phase corresponding to a point in time when low level is changed to high level). Until this point in time, the frequency of the PWM signal does not change. In an aspect in which the frequency of a PWM signal is changed within a predetermined range, the frequency of the PWM signal may be changed at random or regularly increased or decreased with reference to a reference frequency. In addition, the frequency of the PWM signal may be changed at a point in time after the start pulse Dy is supplied twice or more and when a predetermined phase is first reached.

The light source driving circuit 66 eliminates high-frequency components of the PWM signal by using a low-pass filter. Then, the light source driving circuit 66 converts the processed PWM signal into a current and drives each of the LEDs 11R, 11G, and 11B.

Thus, the currents (average) of the LEDs 11R, 11G, and 11B are determined in accordance with the duty ratio of the PWM signal, and the duty ratio is determined in accordance with the average of grayscale values of images for one frame. Thus, in this embodiment, in accordance with the average of grayscale values of images to be displayed, the luminance of each of the LEDs 11R, 11G, and 11B is determined.

For example, in a case where the average of grayscale values of images to be displayed is high, that is, in a case where the overall images to be displayed are bright, the luminance of each of the LEDs 11R, 11G, and 11B is set to high (bright). On the other hand, in a case where the average of grayscale values of images to be displayed is low, that is, in a case where the overall images to be displayed are dark, the luminance of each of the LEDs 11R, 11G, and 11B is set to low (dark). Thus, compared with a configuration in which the amount of light of an LED is constant irrespective of grayscale value, the range (dynamic range) from the minimum value to the maximum value that can be displayed on a display panel can be apparently increased.

Alternatively, the conversion contents of the LUT 62 may be set such that the luminance of each of the LEDs 11R, 11G, and 11B is set to low in a case where the overall images are bright, whereas the luminance of each of the LEDs 11R, 11G, and 11B is set to high in a case where the overall images are dark. In a case where such conversion contents are set, since a bright portion is darkly expressed and a dark portion is brightly expressed, the dynamic range cannot be increased. However, display in which overexposure and underexposure are reduced can be achieved.

Reduction of scroll noise will now be described with reference to FIG. 3.

Since the display data Vd for one frame is supplied in a constant cycle, a vertical scanning period during which scanning of all the scanning lines is performed for each of the display panels 100R, 100G, and 100B, that is, the reciprocal F of the output frequency of the start pulse Dy, is constant.

Figure 3:
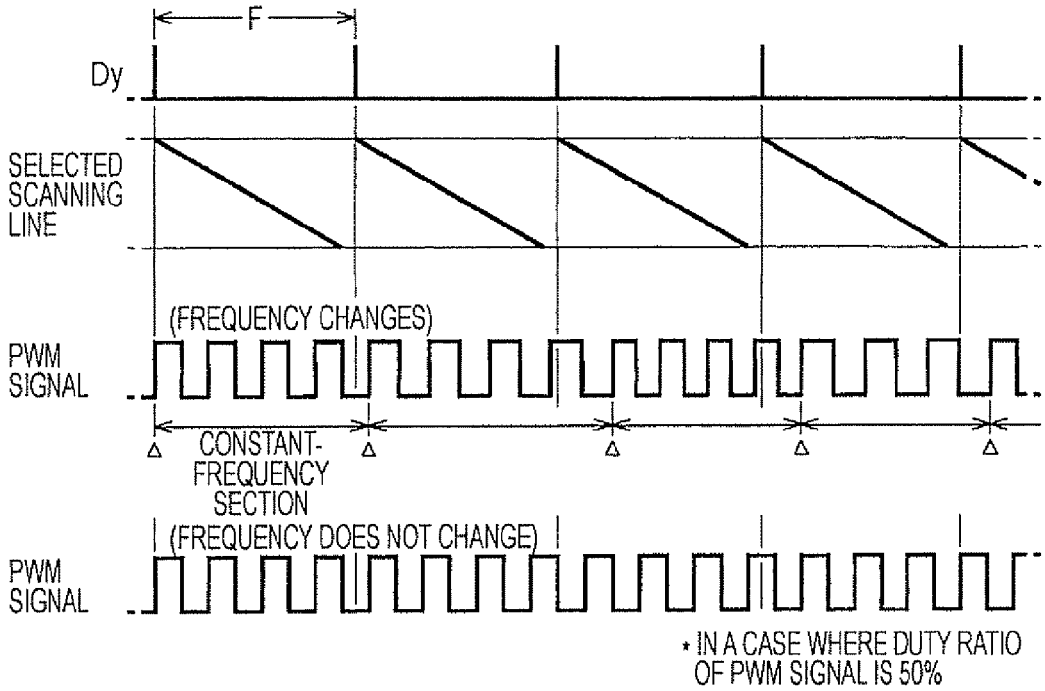
FIG. 3 is a timing chart showing an operation of the projector.

Since scanning lines are sequentially selected from the top after the start pulse Dy is supplied, selected scanning lines are changed with time as shown in FIG. 3. Note that since a scanning line in a single row is selected for each horizontal scanning period, selected scanning lines are changed in a stepwise manner, strictly speaking. However, in FIG. 3, for simplification of explanation, changes in selected scanning lines are expressed in a linear manner.

Meanwhile, although high-frequency components of the PWM signal are eliminated by the light source driving circuit 66, flicker components cannot be completely eliminated. Thus, each of the LEDs 11R, 11G, and 11B is in a bright or dark state in accordance with an high-level or low-level section of the PWM signal. In a case where the fundamental frequency of the PWM signal is constant at a value near an integer multiple of the output frequency of the start pulse Dy, phases of the bright and dark states are shifted with time in a constant direction by a constant amount with respect to the position of a selected scanning line. Thus, horizontal band-shaped bright and dark portions on the screen slowly move upward or downward and such a movement can be easily observed.

However, in this embodiment, since the PWM signal generation circuit 64 changes the frequency of the PWM signal within a predetermined range for substantially each vertical scanning period F, the relationship between the position of a selected scanning line and a bright or dark state is not constant, as shown in FIG. 3. Thus, in this embodiment, horizontal band-shaped bright and dark portions on the screen are not easily observed. Therefore, a degradation in the quality of display can be reduced.

Note that in FIG. 3, an example of the waveform of the PWM signal in a case where the duty ratio represented by the data Dud is 50%.

Furthermore, in this embodiment, the frequency of the PWM signal is changed at points in time represented by A in FIG. 3. More specifically, the frequency of the PWM signal is changed at a point in time after the start pulse Dy is supplied and when a predetermined phase is first reached. Thus, the duty ratio in a section in which the frequency of the PWM signal is constant can be set to a value represented by the data Dud.

Figure 4:
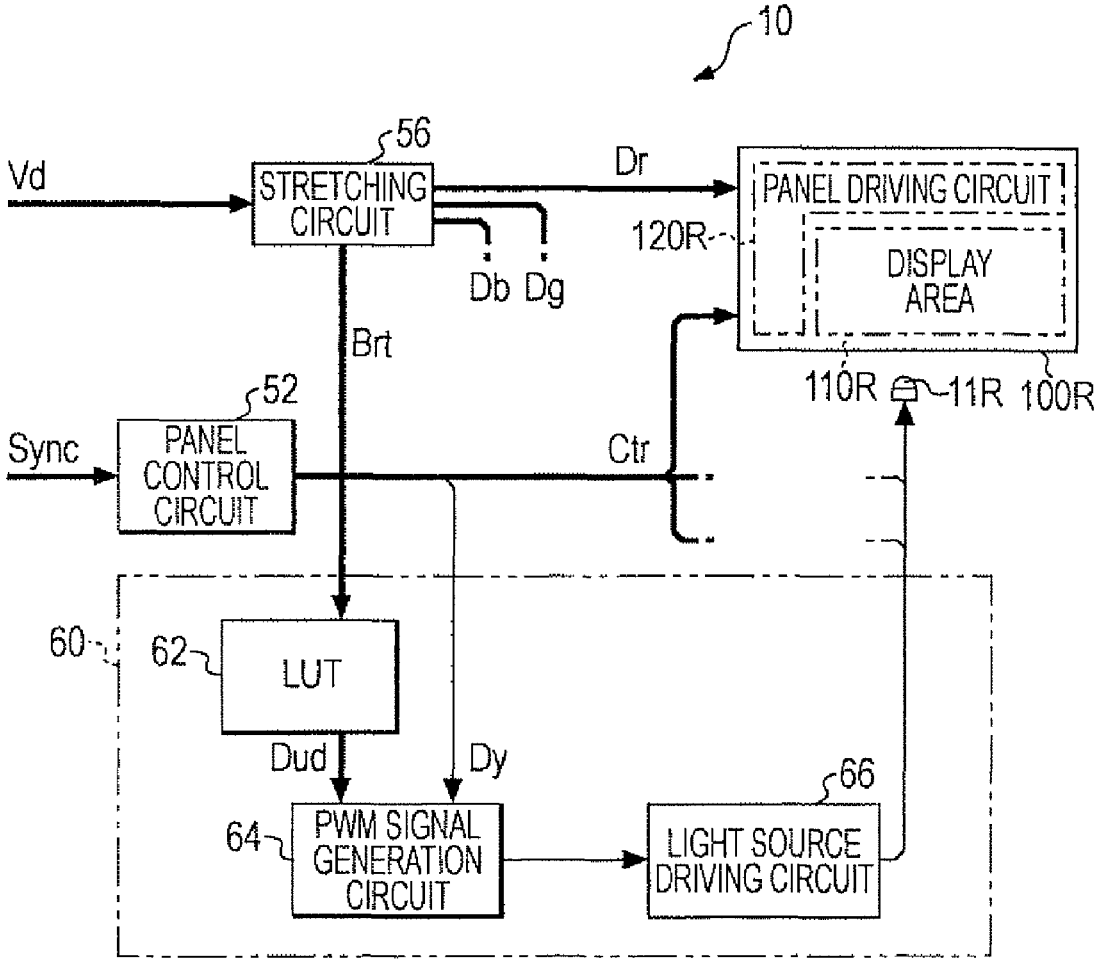
FIG. 4 is a block diagram showing another electrical configuration of the projector.

Note that in the invention, instead of a configuration in which the display data Vd is directly supplied to the panel driving circuit, a stretching circuit 56 may be provided, as shown in FIG. 4, 50 that grayscale values represented by the display data Vd can be stretched.

Figure 5A:
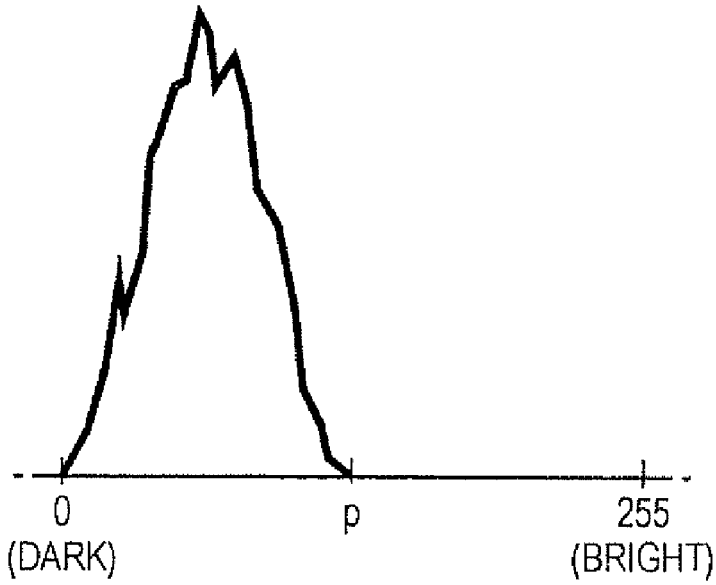
FIGS. 5A and 5B show stretching processing performed by the projector.
Figure 5B:
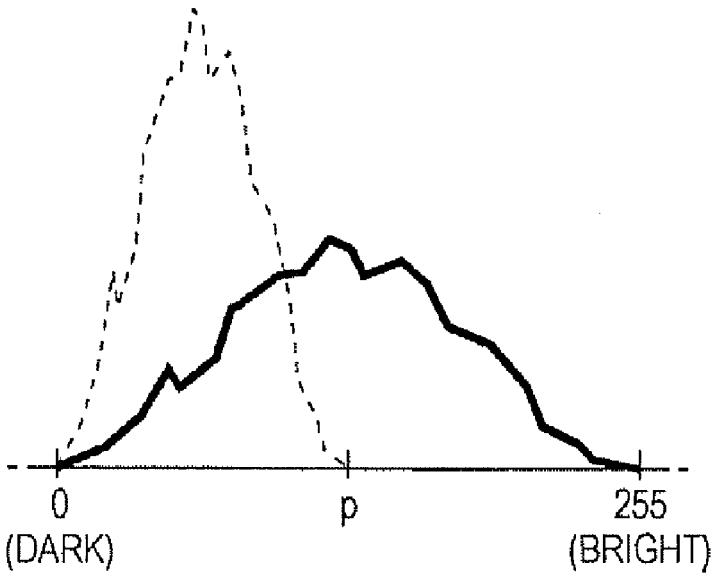

An example of stretching processing performed by the stretching circuit 56 will be described with reference to FIGS. 5A and 5B. In the case of images for one frame defined by the display data Vd, the grayscale values normally range from "0" to "255" in decimal notation, where a grayscale component of one color is represented by eight bits. However, in the case of dark images, grayscale values are concentrated at low levels, as shown in FIG. 5A. In a case where the maximum grayscale value of dark images is represented by "p", the stretching circuit 56 stretches the grayscale values 255/p times, so that the distribution of grayscale values is normalized in such a manner that the grayscale values range from "0" to "255", as shown in FIG. 5B.

Although the case of dark images has been explained above as an example, the distribution of grayscale values is normalized similarly for bright images or images in which grayscale values are concentrated at intermediate levels in such a manner that the grayscale values range from "0" to "255".

Figure 2:
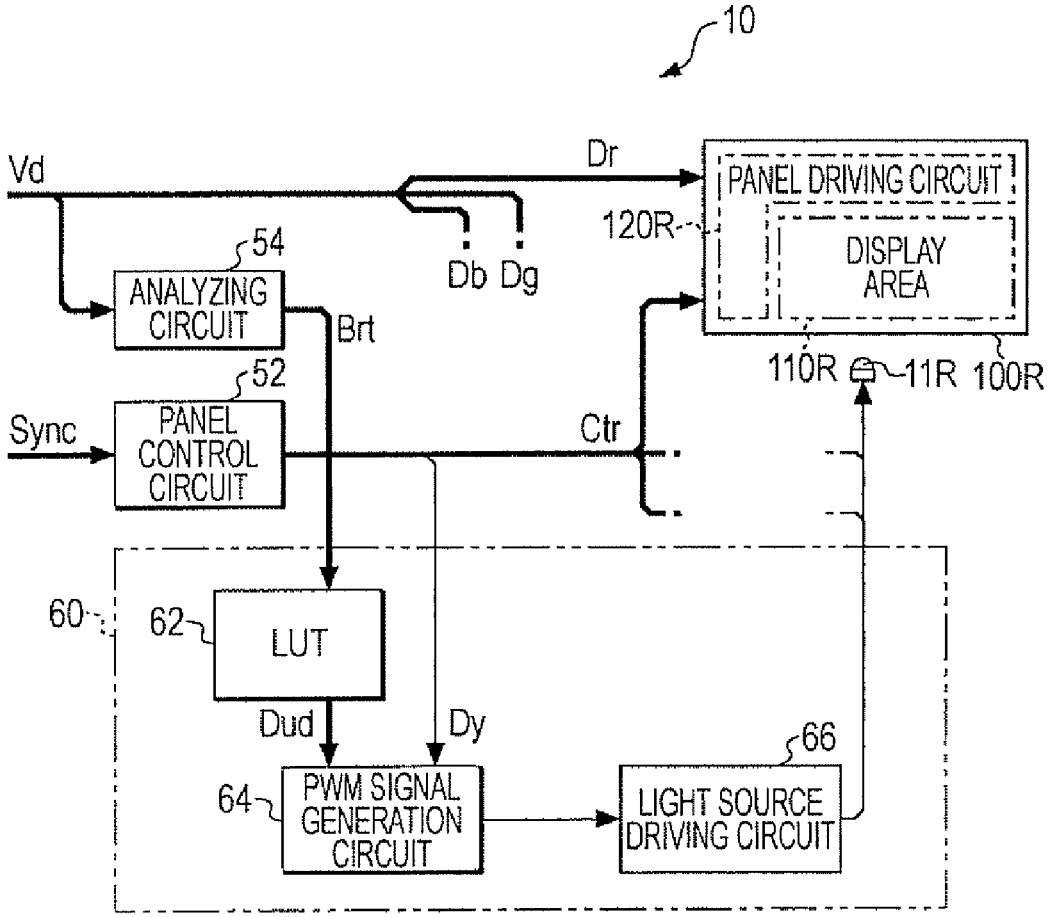
FIG. 2 is a block diagram showing an electrical configuration of the projector.

The normalized display data is obtained from the grayscale values stretched from the original values, the stretching circuit 56 supplies data Brt that represents the average of the stretched grayscale values to the LUT 62, instead of the analyzing circuit 54 shown in FIG. 2.

With this configuration, even in a case where the range of grayscale values of images for one frame represented by the display data Vd supplied from a host apparatus is narrow, the grayscale values can be stretched by the stretching circuit 56 and the amount of light emitted from each of the LEDs 11R, 11G, and 11B is controlled in accordance with the average of the stretched grayscale values. Thus, vivid images can be displayed.

In addition, although the LEDs 11R, 11G, and 11B are driven in accordance with a common PWM signal in the above-described embodiment, the LEDs 11R, 11G, and 11B may be individually driven and the white balance of a combined color image may be adjusted. For example, the PWM signal generation circuit 64 shown in FIG. 2 or FIG. 4 may generate PWM signals for individual colors, red, green, and blue, by multiplying the duty ratio represented by the data Dud by weighting coefficients for individual colors, red, green, and blue, perform current conversion by light source driving circuits individually provided for red, green, and blue, and individually drive the LEDs 11R, 11G, and 11B.

Although an LED is used as an example of a light source in the above-described embodiment, any type of light source can be used as long as it is driven by PWM control. Thus, instead of an LED, a laser diode may be used as a light source.

In addition, in the above-described embodiment, three LEDs, which are light sources, and three display panels are provided so as to correspond to red, green, and blue. However, for example, four or more LEDs and four display panels may be provided in order to increase the color reproducibility. In addition, instead of transmissive liquid crystal panels, reflective liquid crystal panels may be used. In addition, although display panels are driven in a method for sequentially selecting scanning lines from the top in the above-described embodiment, scanning lines can be selected in any order as long as scanning lines are selected at a constant frequency.

Furthermore, although an image display device is applied to a projector in the above-described embodiment, the image display device may also be applied to a device of a direct-view type in which a display image on a liquid crystal panel projected through a backlight or a frontlight as a light source can be directly viewed.

In addition, instead of a liquid crystal panel, any type of device can be used as a display panel as long as it requires a light source. For example, a digital mirror element may be used as a display panel.

The entire disclosure of Japanese Patent Application No. 2008-016608, filed Jan. 28, 2008 is expressly incorporated by reference herein.

What is claimed is:

1. An image display device comprising:

a light source that emits light;

one display area that changes, for each pixel, a transmittance or a reflectance of the light emitted from the light source;

a panel driving circuit that drives the display area on the basis of an image signal indicating the transmittance or the reflectance for each pixel; and a light source control unit that controls the light source to cyclically turn ON and OFF during a plurality of periods wherein each period is defined as a duration of a single ON-OFF cycle, that controls a proportion of light emission time to differ during different periods of the plurality of periods, and that controls the durations of different periods to differ during different periods of the plurality of periods.

2. The image display device according to claim 1, further comprising an analyzing circuit that analyzes a brightness of an image to be displayed in the display area, wherein the light source control unit changes, in accordance with the brightness analyzed by the analyzing circuit, the proportion of the light emission time of the light source in a period of the image signal.

3. The image display device according to claim 1, further comprising a stretching circuit that stretches the transmittance or the reflectance of the light defined by the image signal so as to increase the transmittance or the reflectance.

4. The image display device according to claim 1, wherein the light source includes at least three light sources corresponding to individual colors and the display area includes at least three display areas corresponding to individual colors, wherein the image display device further comprises an optical system that combines light emitted from the individual display areas and projects the combined light, and wherein the light source control unit is capable of controlling, for each of the display areas, the proportion of the light emission time of the light source in the period.

5. An electronic apparatus comprising the image display device according to claim 1.

6. An electronic apparatus comprising the image display device of claim 1, wherein the plurality of periods defines a vertical scanning period, and durations of the different periods of the plurality of periods are controlled by the light source control unit to differ such that a relationship between the vertical scanning period and the duration of the different periods is not constant.

* * * * *